US006386370B1

(12) United States Patent
Wigton et al.

(10) Patent No.: US 6,386,370 B1
(45) Date of Patent: May 14, 2002

(54) TIERED SHADOWBOX POP-UP STRUCTURES

(75) Inventors: Mark D. Wigton, Conyers; Daniel W. Leidig, Suwanee, both of GA (US)

(73) Assignee: Quebecor World (USA) Inc., Greenwich, CT (US)

( * ) Notice: Subject to any disclaimer, the term of this patent is extended or adjusted under 35 U.S.C. 154(b) by 0 days.

(21) Appl. No.: 09/596,917

(22) Filed: Jun. 20, 2000

(51) Int. Cl.[7] ..... B65D 5/50

(52) U.S. Cl. ..... 206/763; 40/124.16; 206/486; 206/755; 229/120.21

(58) Field of Search ..... 206/740, 744, 206/745, 751, 765, 486, 774; 229/120.21, 117.01; 40/124.08, 124.16, 539

(56) References Cited

U.S. PATENT DOCUMENTS

| | | | | | |
|---|---|---|---|---|---|
| 2,147,134 | A | * | 2/1939 | Addis et al. | 206/763 |
| 2,148,279 | A | * | 2/1939 | Sandberg | 40/124.08 |
| RE21,592 | E | * | 10/1940 | Addis et al. | 206/763 |
| RE22,109 | E | * | 6/1942 | Hayes | 40/124.16 |
| 2,833,457 | A | * | 5/1958 | Tyrseck | 206/763 |
| 4,146,983 | A | | 4/1979 | Penick et al. | |
| 4,337,589 | A | | 7/1982 | Volkert et al. | |
| 4,349,973 | A | | 9/1982 | Penick et al. | |
| 4,592,573 | A | | 6/1986 | Crowell | |
| 4,874,356 | A | * | 10/1989 | Volkert | 40/124.08 |
| 4,885,859 | A | * | 12/1989 | Gasser | 40/539 |
| 4,949,482 | A | | 8/1990 | Price | |
| 5,317,823 | A | * | 6/1994 | Brunt, II | 40/124.1 |
| 5,588,233 | A | | 12/1996 | Volkert et al. | |
| 5,595,008 | A | | 1/1997 | Johnson | |
| 5,687,495 | A | | 11/1997 | Volkert | |
| 5,833,789 | A | | 11/1998 | Rosedale et al. | |
| 5,933,989 | A | | 8/1999 | Volkert et al. | |
| 5,943,800 | A | | 8/1999 | Rose | |
| 5,961,149 | A | | 10/1999 | Hunt | |

* cited by examiner

*Primary Examiner*—Bryon P. Gehman
(74) *Attorney, Agent, or Firm*—Dean W. Russell, Esq.; Kristin D. Mallatt, Esq.; Kilpatrick Stockton LLP

(57) ABSTRACT

Three-dimensional structures are preferably formed of folded printed material which becomes three-dimensional and exhibits a shadowbox effect when in the open position, but which remains substantially two-dimensional when closed. The structures are formed from a base sheet having a plurality of fold-lines that define a plurality of panels. Two panels are hinged and may be opened to display one or more tiers, which are defined by additional panels. Optionally, one or more panels may have cutout sections, particularly the panels forming the tiers, thereby providing a tiered shadowbox effect.

20 Claims, 4 Drawing Sheets

TIERED SHADOWBOX POP-UP STRUCTURES

FIELD OF INVENTION

The present invention relates to systems and methods for forming three-dimensional structures and to the three-dimensional structures. The structures are preferably formed of folded printed material which becomes three-dimensional and exhibits a shadowbox effect when in the open position, but which remains substantially two-dimensional when closed.

BACKGROUND OF INVENTION

Advertising handouts, direct-mail pieces, and the like are being used with greater frequency to promote products and/or services. Their value often lies in the ability to command attention. One way such structures command attention is by incorporating a three-dimensional or pop-up section. Typical pop-up structures usually consist of a pair of hinged panels and a pop-up element that rises upward from a substantially flat, single plane to assume a three-dimensional orientation upon opening of the hinged panels. Structures having pop-up elements are more likely to attract the attention of the viewer and enhance the chances that the promotional material will be read.

Because pop-up structures are often transported through the mail, it is desirable that they remain substantially flat when in the closed position. This flatness makes transport more economical and also highlights the effect of the pop-up element once the structure is placed in its open position.

Generally, the manufacture of pop-up structures requires a number of steps, such as printing, perforating, cutting, gluing, and folding. In order for a structure to be manufactured economically, it must be designed so that it can be produced by mass-production, or at least by machine-production, without substantial amounts of manual labor. This requirement of economic mass-production has limited the types of structures that may be formed. While more elaborate structures are desirable, the need to cut multiple panels, assemble, and glue them together renders them impractical for mass mailings.

For instance, some pop-up structures provide two interconnected hinged panels and a main display pop-up element having supporting structures or "legs" extending from the main display area. Each supporting structure or "leg" is secured to one of the two hinged panels so that when the hinged panels are unfolded, the main display area pops up from the panels. See e.g., U.S. Pat. No. 5,943,800 issued to Rose. Producing such a pop-up structure requires multiple separate manufacturing steps. The two hinged panels are produced separately from the main display pop-up element, the materials are cut and printed, and then they are attached.

Additionally, pop-up structures have been manufactured to provide a resulting pop-up structure that is box-like. See e.g., U.S. Pat. No. 4,949,482 issued to Price. Such structures are formed by folding a first sheet and attaching a second sheet. The resulting structure is box-like and can draw the viewer's attention to promotional material printed on the structure. This structure, as with the structure disclosed in the patent to Rose, requires attaching multiple sheets to each other, is relatively expensive to manufacture, and does not provide a shadowbox or an elaborate three-dimensional pop-up effect.

A need therefore exists for structures that incorporate more elaborate pop-up elements for commanding the attention of viewers. A need furthermore exists for systems and methods for forming the structures in ways that lend, themselves to economical mass-production.

SUMMARY OF INVENTION

The present invention according to a preferred embodiment relates to a tiered shadowbox pop-up structure. The structure is particularly useful in attracting the attention of the viewer and enhancing the effectiveness of promotional material. When in the closed position, the shadowbox pop-up structure appears substantially flat. When in the open position, the shadowbox pop-up structure has two hinged panels that open to display tiers that are defined by additional panels, thereby creating a tiered shadowbox pop-up effect.

The preferred shadowbox pop-up structure is comprised of at least one base sheet of material which may contain printed material. The base sheet may be perforated so that it can be easily folded. The base sheet is formed from a blank that is folded so that a number of panels are formed, each panel being connected to another panel along a fold-line. The first two panels formed provide hinged panels, so that once the structure is formed, the hinged panels open to display additional panels.

The additional panels provide the tops, bottoms, and sides of one or multiple tiers. More particularly, each tier is defined by top, bottom, and side panels. One or more of these panels may be mutually shared by more than one tier. Additionally, one or more panels defining one or more of the tiers may optionally have cutout sections or functional and/or hinged features, creating a tiered shadowbox effect when the structure is formed and in the open position.

Essentially, the structure is made of a base sheet that has a plurality of fold-lines that define a plurality of panels. The plurality of panels include an elongated panel and a foundation panel connected along a fold-line, a top tier panel defining at least a portion of a first tier, a lower tier panel defining at least a portion of a second tier. The top tier panel and the lower tier panel each cooperate with both the elongated panel and the foundation panel, so that when the elongated panel is pivoted from the foundation panel about the fold-line, the elongated panel and foundation panel form a space, and the space displays the first and second tiers.

In another embodiment of the present invention, a second sheet of material is attached as a bottom panel, forming a bottom cover. This second sheet of material provides support and is used as an additional way to open the structure. In other embodiments of the present invention, there may be one tier, two tiers, or a plurality of tiers formed by a plurality of panels.

Other features and advantages of the present invention will become apparent from the following detailed description in conjunction with the accompanying drawings, which illustrate, by way of example only, the features of the present invention and are not intended to limit the invention in any way.

BRIEF DESCRIPTION OF DRAWINGS

The accompanying drawings, which are incorporated in and form a part of the specification, illustrate preferred embodiments of the present invention and, together with the description, disclose the principles of the invention. In the drawings.

DETAILED DESCRIPTION

The present invention generally relates to three-dimensional structures that have pop-up elements formed by tiers. The structures may be used in a number of ways to convey information or to provide a visual three-dimensional effect. For example, they may be used as promotional material for a mass-mailing. In one embodiment, which will be described in more detail below, the structures serve to catch potential consumers' attention more effectively than a flat, two-dimensional mailer. The structures of the present invention may also be suitable for use in tree-dimensional greeting cards, for poster board displays, and numerous additional uses that will be apparent to those skilled in the art.

Figure 1A:
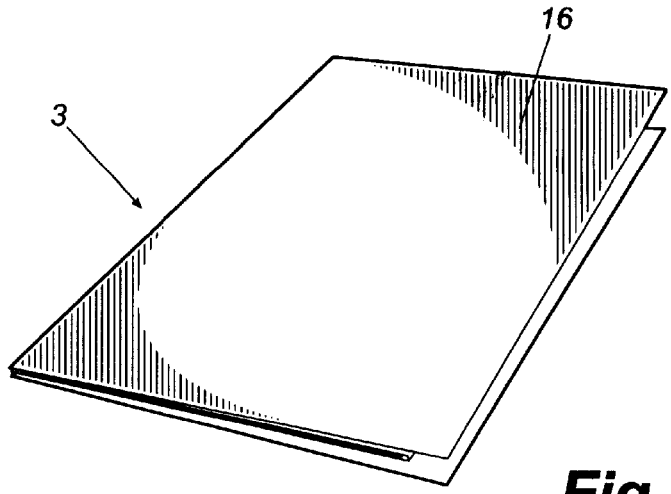
FIG. 1A is a perspective view a structure according to a preferred embodiment of the present invention in a closed position.
Figure 1B:
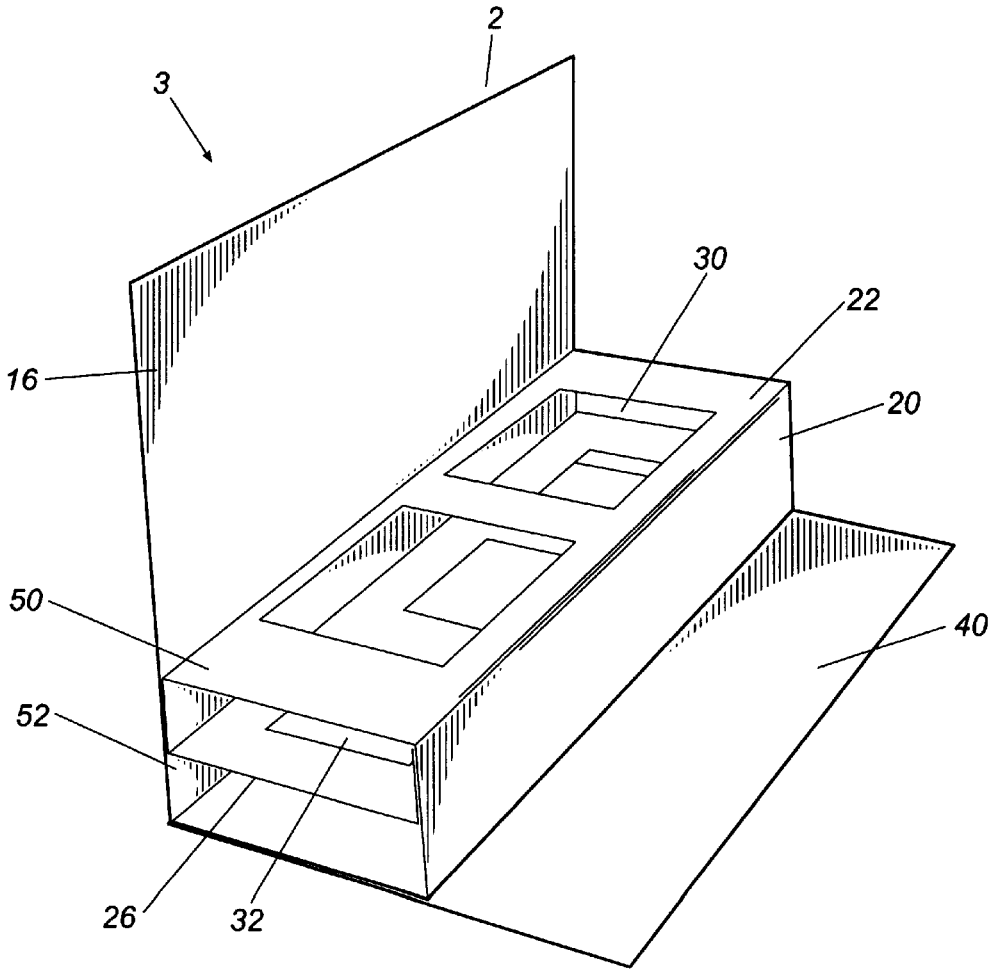
FIG. 1B is a perspective view of the structure of FIG. 1A in an open and assembled position.

FIG. 1A shows a shadowbox pop-up structure 3 of one embodiment of the present invention in a closed position. In the closed position, the structure 3 is substantially flat. When an elongated panel 16 is lifted, as shown in FIG. 1B, the structure 3 becomes three-dimensional and displays tiers.

When open, the structure 3 has tiers 50 and 52 that are formed in part by top tier panel 22 and lower tier panel 26, respectively. Tiers 50 and 52 are supported by an outer side panel 20. Although the top tier panel 22 and the lower tier panel 26 appear to extend directly from the elongated panel 16, as though they were formed and attached separately, the structure 3, including panels 22 and 263w and the additional panels described below, is formed by folding one base sheet 2 into a plurality of panels, discussed with reference to FIGS. 2–4. Both the top tier panel 22 and the lower tier panel 26 are shown having optional cutout sections 30 and 32. Additional panels may also have similar or different cutout sections, or the structure 3 may be formed without cutout sections 30 and 32. A bottom cover 40 is attached underneath structure 3, below tiers 50 and 52.

Figure 2:
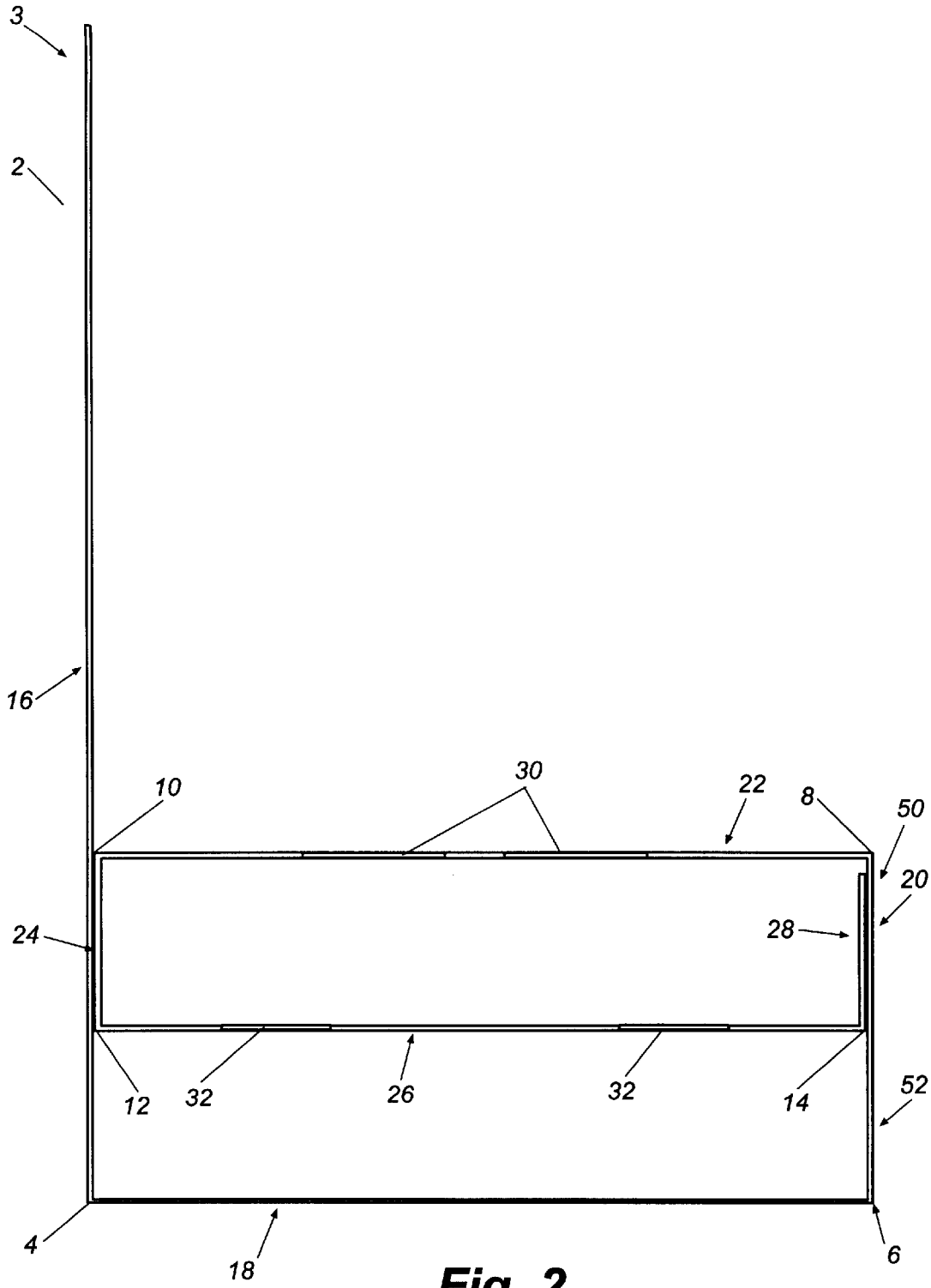
FIG. 2 is a side view of the structure in an open and folded position.
Figure 3:
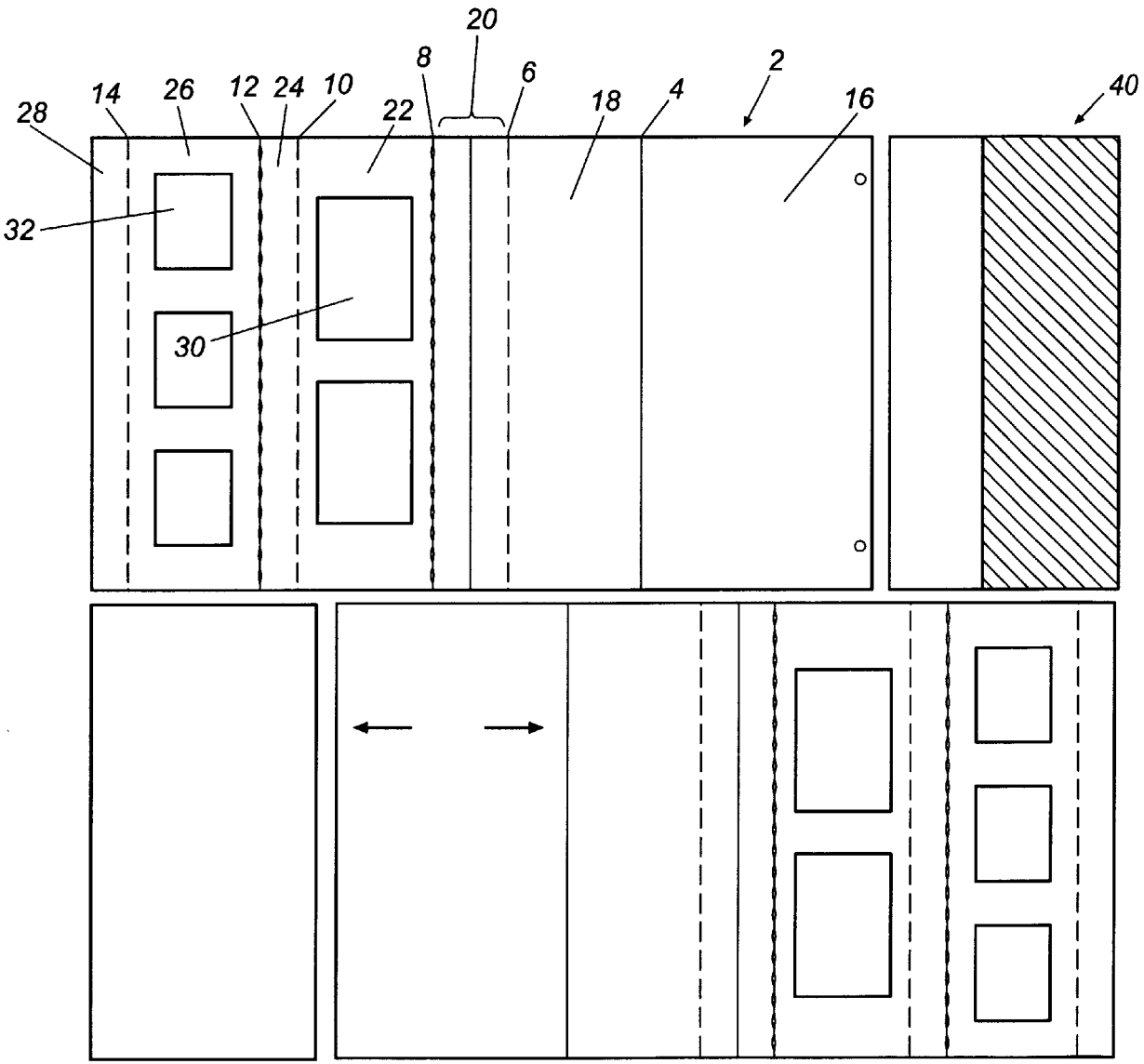
FIG. 3 is a top plan view of the structure in its pre-configuration state.

As shown in FIGS. 2 and 3, base sheet 2 includes a plurality of panels 16, 18, 20, 22, 26, and 28 which are interconnected to one another along a plurality of fold-lines 4, 6, 8, 10, 12, and 14. Fold-lines 4, 6, 8, 10, 12, and 14 may be lines of weakness formed in the base sheet 2 by scoring, creasing, perforating, and the like. Panels 16, 18, 20, 22, 26, and 28 may have printed material located thereon. This enables the structure 3 to be particularly useful for advertising. The printed material may be fixed image data, which is material that does not change, such as advertising slogans or information, or variable image data, which is information that typically changes on each mailpiece. For example, the name and address on each mailpiece may be changed while keeping the rest of the printed material the same. Such use of printed material further enhances the eye-catching effect of the structure 3.

The panels of the base sheet 2 are arranged so two tiers 50 and 52 are formed. As best seen in FIG. 2, when the structure 3 is in the open position, each panel is formed at an angle substantially perpendicular to an adjacent panel, so that when the structure 3 is fully opened, the top tier panel 22 and the lower tier panel 26 each extend at an angle that is substantially perpendicular from the elongated panel 16, thereby forming tiers 50 and 52.

The top tier 50 is in the shape of a quadrilateral, and more particularly, the shape of a parallelogram or a rectangle. The longer sides of the rectangle form the top tier panel 22 and the lower tier panel 26, both shown being diecut with cutout patterns 30 and 32, so that a shadowbox effect is obtained when the structure 3 is opened. One of the shorter sides of the top tier 50 is formed by the upper portion of the outer side panel 20 and connection panel 28, where the two overlap. The other shorter side of top tier 50 is formed by an inner side panel 24.

The lower tier 52 is, also in the shape of a quadrilateral, and more particularly, the shape of a parallelogram or a rectangle. The longer sides of lower tier 52 are formed by the lower tier panel 26 (which is also shown as forming a longer side of the top tier 50), and a foundation panel 18. The shorter sides of the lower tier 52 are formed by a lower portion of the outer side panel 20 and by a lower portion of elongated panel 16. Tiers 50 and 52 are positioned so that they abut elongated panel 16. If the structure 3 is in the closed position shown in FIG. 1A and the elongated panel 16 is lifted, as shown in FIG. 1B, the structure 3 becomes three-dimensional and exhibits a double tier shadowbox effect.

FIG. 2 further illustrates the top tier panel 22 and the lower tier panel 26 having cutout sections 30 and 32, which present the shadowbox effect when the shadowbox pop-up structure 3 is folded in a particular configuration. Cutout sections 30 and 32 may also be functional and/or hinged sections, described in more detail below. Although the panels 22 and 26 are shown as having cutout sections 30 and 32, it is not required that there be any cutouts sections. Additionally, any of the panels of the base sheet 2 may have one or more cutout sections.

Referring back to FIG 1B, the structure 3 according to this embodiment of the present invention has the bottom cover 40 attached to the foundation panel 18 of the base sheet 2 once base sheet 2 has been folded to form the structure 3. Bottom cover 40 provides support to the base sheet 2 and serves as a base when opening the structure 3. The elongated panel 16 and bottom cover 40 collapse on top of each other when the pop-up structure 3 is closed, as shown in FIG. 1A. FIG. 2 illustrates the structure 3 which does not have the bottom cover 40, such as before the bottom cover 40 has been attached.

FIG. 3 shows the base sheet 2 and the bottom cover 40 in a pre-configuration state. As illustrated, the base sheet 2 is substantially longer than the bottom cover 40. The base sheet 2 and the bottom cover 40 may be formed of any suitable material, such as paper, fiberboard, lightweight plastic, film-based substrates, synthetics, laminates, extrusions, cellulose-based material, or the like. A medium-weight paper-weight stock may be preferred in many instances.

Prior to folding, the base sheet 2 is cut to the desired dimensions and printed with the desired material. Base sheet 2 is shown having at least two cutout sections 30 and 32 die cut into the base sheet 2 on panels 22 and 26. As described above, cutouts sections 30 and 32 may also be made on any of the panels of the base sheet 2, depending on the desired effect. In the illustrated embodiment, cutout sections 30 and 32 are rectangular, however, any desired shape or size may be used.

By way of non-limiting examples, cutout sections 30 may be square in order to emulate a store window, may be in the shape of a tree, a balloon, a door, an animal, or the like. These shapes may be useful in advertising material, for example, to show a store front with consumers walking in and out of the door, or to show a window through which consumers are viewing merchandise. A tree shape may be useful in advertising a park or an outdoor social event. Any shape may be used, such as a shape that would more accurately reflect the item being sold, or any shape that is intended to catch a viewer's attention. Cutout sections 30 are formed by cutting, and more particularly by diecutting. The section may be entirely removed or a cut may be made on one side to provide a working door-like effect. Fold-lines may also be formed, which may comprise lines of weakness formed in base sheet 2 by scoring, creasing, perforating, and the like, or may optionally simply be marked if necessary by indicia indicating where folding is to take place.

Figure 4:
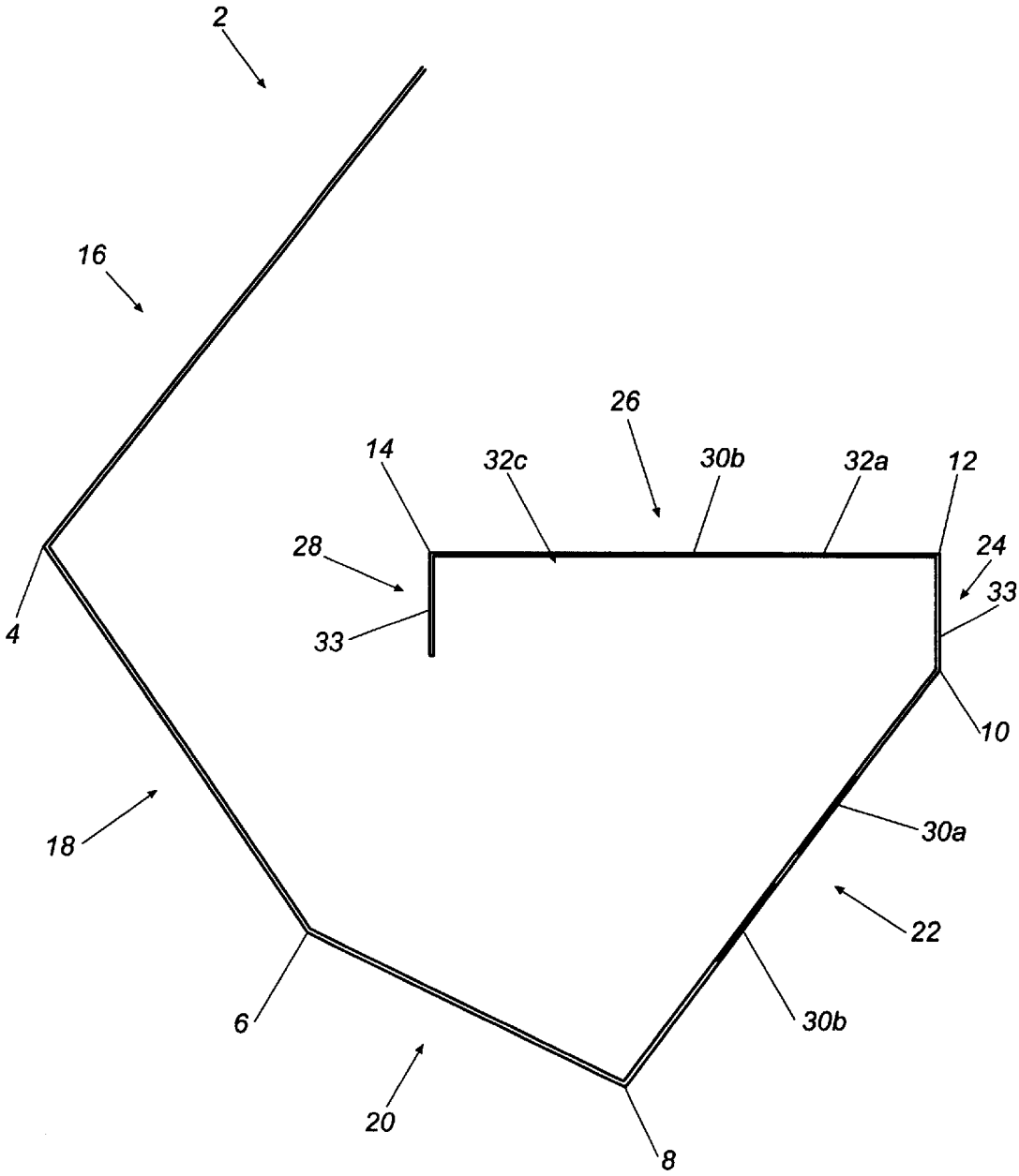
FIG. 4 is a side view of the structure in the process of being folded.

Next, an adhesive pattern 33 is applied to one or more of the panels 24, 28, 16, 20, at any location on any of the panels. The adhesive pattern 33 indicated in FIG. 4 is shown as being located on or around the middle surfaces of panels 24 and 28, but may be located anywhere on the panels 24, 28, 16, and 20 or anywhere necessary for the formation of the structure 3. For example, the adhesive pattern 33 may cover an entire panel, may be located at a corner or fold-line of a panel, or may be located on a middle surface as shown. Any suitable adhesive may be used, non-limiting examples including hot-melt, solvent-based, laminating, extrusions, emulsions, water-based, UV curable, EB (electron beam) curable, or co-adhesive patterns of a material that will only adhere to itself which are applied to appropriate locations of opposite surfaces.

As shown in FIG. 4, generally, the base sheet 2 comprises six folds 4, 6, 8, 10, 12, and 14, dividing base sheet 2 into seven panels 16, 18, 20,22, 24, 26 and 28. Each fold provides two panels which may be folded so that they are substantially perpendicular to one another. As shown in FIG. 4, the base sheet is first folded along the fold-line 4, which forms the elongated panel 16 and the foundation panel 18, with these panels being substantially perpendicular to each other when the structure 3 is folded and in the open position. A second fold-line 6 forms the outer side panel 20, which extends at an angle substantially perpendicular to the foundation panel 18 and substantially parallel to the elongated panel 16 when the structure 3 is folded and in the open position. A third fold-line 8 forms the top tier panel 22. The top tier pan,l 22 is shown having cut-out sections 30*a* and 30*b*, described above. A fourth fold-line 10, forms the inner side panel 24. A fifth fold-line 12 forms the lower tier panel 26.

The lower tier panel 26 is shown having cutout section 32*a*, 32*b*, 32*c*, described above. In one embodiment, the cutout section 32 provides designs or openings that are offset from the designs or openings of the cutout section 30. When the base sheet 2 is in its open position, the cutout section 32 appears behind the cutout section 30, creating a shadowbox effect. This shadowbox effect is shown in greater detail in FIG. 1B.

Referring back to FIG. 4, a sixth fold-line 14 forms the connection panel 28. The connection panel 28 is attached to the outer side panel 20 by an adhesive pattern 33, non-limiting examples of which are described above. The adhesive pattern 33 may be applied to the connection panel 28 (as shown) or to the outer side panel 20 (not shown) or to both, depending on the nature of the adhesive used. The adhesive pattern 33 may also be applied in such a way as to attach the inner side panel 24 to the elongated panel 16. For example, the adhesive pattern 33 maybe applied to the inner side panel 24 or to the elongated panel 16 or to both, depending again on the nature of the adhesive used. As noted above, the adhesive pattern 33 may be located on an entire panel, on a portion of a panel, on a corner of the panels, or any combination thereof.

The above description describes the structure 3 having tier 50 formed by folding base sheet 2 and located above tier 52. The base sheet 2 is folded and configured so that the panels forming the tiers 5C, and 52 are essentially folded "on top" of one another to form the tiers 50 and 52. The structure 3 additionally provides for tiers 50 and 52 that share the lower tier panel 26 (which forms the bottom of tier 50 and the top of tier 52) and the outer side panel 20 (which forms the one side of each tier 50 and 52).

However, it is understood that the base sheet 2 may be folded in such a way and in a number of configurations, still forming a shadowbox structure according to the present invention. For instance, there may be additional fold-lines to form additional tiers, the tiers may be formed in a different order, may be secured in different locations, and may share different panels or have no panels in common, or the tiers may be formed without a connection panel 28 (which secures the tiers in place) and instead may be secured by having an end of a panel secured directly to a fold-line or directly to a portion of another panel.

The foregoing description of the preferred embodiments of the invention has been presented only for the purpose of illustration and description and is not intended to be exhaustive or to limit the invention to the precise forms disclosed. Many modifications and variations are possible in light of the above teaching.

The embodiments were chosen and described in order to explain the principles of the invention and their practical application so as to enable others skilled in the art to utilize the invention and various embodiments and with various modifications as are suited to the particular use contemplated.

What is claimed is:

1. A collapsible pop-up structure comprising:

a base sheet having a plurality of fold-lines that define a plurality of panels, the plurality of panels comprising:

(a) an elongated panel and a foundation panel connected along a fold-line such that the elongated panel and the foundation panel can be pivoted toward or away from one another in use;

(b) a top tier panel defining at least a portion of a first tier; and (c) a lower tier panel defining at least a portion of a second tier;

wherein the top tier panel and the lower tier panel cooperate with both the elongated panel and the foundation panel so that when the elongated panel is pivoted away from the foundation panel about the fold-line, the elongated panel and foundation panel from a space containing the first and second tiers, and when the elongated panel is pivoted toward the foundation panel about the fold-line, the structure lies substantially flat.

2. The structure of claim 1, wherein the top tier panel and the lower tier panel each have first ends and second ends, the first ends being coupled to the elongated panel, the second ends being coupled to an outer side panel, and the outer side panel being coupled to the foundation panel.

3. The structure of claim 1, wherein the first tier is in the shape of a first parallelogram having:

(a) a top defined by the top tier panel;

(b) a bottom defined by the lower tier panel; and (c) two sides, defined at least in part by the elongated panel and an outer side panel;

and wherein the second tier is in the shape of a second parallelogram having:

(d) a top defined by the lower tier panel, (e) a bottom defined by the foundation panel;

(f) two sides defined at least in part by the elongated panel and the outer side panel.

4. The structure of claim 1, wherein at least one of the panels has a cutout section.

5. The structure of claim 1, wherein at least one of the top tier panel and the lower tier panel has a cutout section.

6. The structure of claim 1, wherein at least one of the panels contains printed material.

7. The structure of claim 6, wherein the printed material is variable data.

8. The structure of claim 1, wherein the top tier panel and lower tier panel lie in a substantially flat position when the elongated panel and the foundation panel are collapsed in a closed position and are activated to form the first and second tiers when the elongated panel and foundation panel are pivoted from one another.

9. A structure comprising:

a base sheet having a plurality of fold-lines that define a plurality of panels, the plurality of panels comprising:

(a) en elongated panel and a foundation panel connected along a first fold-line;

(b) a top tier panel defining at least a portion of a first tier, wherein the top tier panel has first and second ends, the first end being connected to an inner side panel by a second fold line, the inner side panel adhered to the elongated panel, the second end being coupled to an outer side panel; and (c) a lower tier panel defining at least a portion of a second tier; wherein the lower tier panel has first and second ends, the first end coupled to the inner side panel by a third fold line, the second end being coupled to a connection panel by a fourth fold-line which is adhered to the outer side panel, the outer side panel being coupled to the foundation panel, the panels forming a quadrilateral, wherein the inner side panel is coupled to the elongated panel and the connection panel is coupled to the outer side panel, and wherein when the elongated panel is pivoted from the foundation panel about the fold-line, the elongated panel and foundation panel form a space containing the first and second tiers.

10. A structure comprising:

a base sheet having a plurality of fold-lines that define a plurality of panels, the plurality of panels comprising:

(a) an elongated panel and a foundation panel connected along a fold-line;

(b) a top tier panel defining at least a portion of a first tier;

(c) a lower tier panel defining at least a portion of a second tier; and (d) a bottom cover attached to the foundation panel, the bottom cover extending at least partially beyond the foundation panel and providing additional support for the structure;

wherein the top tier panel and the lower tier panel cooperate with both the elongated panel and the foundation panel so that when the elongated panel is pivoted from the foundation panel about the fold-line, the elongated panel and foundation panel form a space containing the first and second tiers.

11. A shadowbox pop-up structure comprising:

(a) a base sheet having six fold-lines to form seven panels; the base sheet comprising a first panel connected by a first fold-line to a second panel, the second panel connected by a second fold-line to a third panel, the third panel connected by a third fold-line to a fourth panel, the fourth panel connected by a fourth fold-line to a fifth panel, the fifth panel connected by a fifth fold-line to a sixth panel, and the sixth panel connected by a sixth fold-line to a seventh panel;

(b) the fifth panel being coupled to the first panel and the seventh panel being coupled to the third panel so that two tiers are formed;

(c) a first tier of the two tiers defined at least in part by the fourth panel; and (d) a second tier of the two tiers defined at least in part by the sixth panel.

12. The structure of claim 11, wherein the panels are formed by in-line folds.

13. A blank for forming a shadowbox pop-up structure, the blank comprising:

a base sheet having six fold-lines to form seven panels, the base sheet comprising:

(a) a first panel for forming an elongated upright panel that when formed is substantially perpendicular to a second panel, the first and second panels being folded so that they form a hinge, the second panel providing a foundation for the structure;

(b) a third panel forming an outer side panel that when formed is substantially perpendicular to the second panel;

(c) a fourth panel forming a top tier panel that when formed is substantially perpendicular to the third panel;

(d) a fifth panel forming an inner side panel that when formed is substantially perpendicular to the fourth panel, the fourth and fifth panels being folded so that the fourth panel when formed is substantially parallel to the second panel and the fifth panel when formed is substantially parallel to the first and third panels and attached to the first panel;

(e) a sixth panel forming a lower tier panel that when formed is substantially perpendicular to the fifth panel;

(f) a seventh panel forming a connection panel that when formed is substantially perpendicular to the sixth panel and that is attached to the third panel;

(g) at least one of the panels have printed material located thereon; and (h) at least one of the panels having a cutout section; wherein the panels are folded to form the shadowbox pop-up structure that lies substantially flat when in a folded position, but that displays a three-dimensional effect when in the open position.

14. The blank of claim 13, further comprising a bottom cover that when formed is coupled to the second panel and extends at least partially beyond the second panel.

15. A method of making a shadowbox pop-up structure having tiers, comprising:

(a) printing data on a base sheet;

(b) forming cutout sections into appropriate sections of the base sheet;

(c) forming crease-lines defining a plurality of panels, wherein first and second panels define a hinge, a third panel provides outside support for the tiers, a fourth panel defines at least a portion of a first top tier, a fifth panel provides a connection to the first panel and provides support for the tiers, a sixth panel defines at least a portion of a second lower tier, and a seventh panel provides a connection to the third panel and support for the tiers; and (d) applying adhesive to appropriate panels in order to secure the structure.

16. The method of claim 15, further comprising attaching a bottom cover to the second panel to provide additional support for the structure.

17. The method of claim 15, wherein the data is fixed image data.

18. The method of claim 15, wherein the data is variable image data.

19. A structure comprising:

a base sheet having a plurality of fold-lines that define a plurality of panels, the plurality of panels comprising:

(a) a first panel and a second panel connected along a fold line;

(b) a third panel and a fourth panel defining at least portions of a first tier and a second tier, respectively, the third and fourth panels each having first and second ends, the first ends of the third and fourth panels being coupled to the first panel; and (c) a filth panel supporting the third and fourth panels and coupling the second ends of the third and fourth panels to the second panel;

wherein when the first panel is pivoted from the second panel about the fold line, the first and second panels form a space displaying the first and second tiers.

20. The structure of claim 19, further comprising a bottom cover attached to and extending at least partially beyond the second panel.

* * * * *

UNITED STATES PATENT AND TRADEMARK OFFICE

CERTIFICATE OF CORRECTION

PATENT NO. : 6,386,370 B1 
DATED : May 14, 2002
INVENTOR(S) : Mark D. Wigton et al.

It is certified that error appears in the above-identified patent and that said Letters Patent is hereby corrected as shown below:

Column 3,
Line 35, delete “263w” and substitute -- 26 -- therefor

Column 4,
Line 11, delete “is,” and substitute -- is -- therefor
Line 44, add a comma after “40”

Column 5,
Line 32, add a space between “20, 22”
Line 7, delete “pan,1” and substitute -- panel -- therefor Column 6,
Line 7, delete “5C,” and substitute -- 50, -- therefor
Line 53, delete “from” and substitute -- form -- therefor Column 7,
Line 26, delete “en” and substitute -- an -- therefor Signed and Sealed this Fourth Day of February, 2003

JAMES E. ROGAN
*Director of the United States Patent and Trademark Office*